United States Patent [19]

Winslow et al.

[11] Patent Number: 5,039,999

[45] Date of Patent: Aug. 13, 1991

[54] ACCUMULATOR AND PRESSURE CONTROL FOR INK-KET PENS

[75] Inventors: Thomas H. Winslow; Bruce A. Anderson, both of Corvallis, Oreg.

[73] Assignee: Hewlett-Packard Company, Palo Alto, Calif.

[21] Appl. No.: 545,263

[22] Filed: Jun. 26, 1990

[51] Int. Cl.[5] ..... B41J 2/175

[52] U.S. Cl. ..... 346/140 R; 138/31

[58] Field of Search ..... 346/140; 138/31

[56] References Cited

U.S. PATENT DOCUMENTS

| | | | |
|---|---|---|---|
| 3,296,624 | 1/1967 | Ascoli . | |
| 3,452,361 | 6/1969 | Williams Jr. . | |
| 4,149,172 | 4/1979 | Heinzl et al. . | |
| 4,207,012 | 6/1980 | Kuparinen . | |
| 4,217,058 | 8/1980 | Straszewski et al. . | |
| 4,272,773 | 6/1981 | Halasz . | |
| 4,342,042 | 7/1982 | Cruz-Uribe et al. . | |
| 4,382,707 | 5/1983 | Anderka . | |
| 4,412,232 | 10/1983 | Weber et al. | 346/140 |
| 4,419,678 | 12/1983 | Kasugayama et al. . | |
| 4,436,439 | 3/1984 | Koto . | |
| 4,442,084 | 12/1983 | Saito . | |
| 4,490,728 | 12/1984 | Vaught et al. . | |
| 4,500,895 | 2/1985 | Buck et al. . | |
| 4,503,443 | 3/1985 | Dagna et al. | 346/140 |
| 4,509,062 | 4/1985 | Low et al. | 346/140 |
| 4,539,568 | 9/1985 | Lewis . | |
| 4,571,599 | 2/1986 | Rezanka | 346/140 |
| 4,671,692 | 6/1987 | Inaba . | |
| 4,673,955 | 6/1987 | Ameyama et al. . | |
| 4,677,447 | 6/1987 | Nielsen . | |
| 4,714,937 | 12/1987 | Kaplinsky . | |
| 4,771,295 | 9/1988 | Baker et al. . | |
| 4,785,314 | 11/1988 | Terasawa et al. . | |
| 4,791,438 | 12/1988 | Hanson et al. | 346/140 |
| 4,794,409 | 12/1988 | Cowger et al. | 346/140 |
| 4,992,802 | 2/1991 | Dion | 346/140 X |

OTHER PUBLICATIONS

Robert C. Durbeck et al., (*Output Hardcopy Devices,* Academic Press 1988) Chapter 13, "Ink Jet Printing" by William J. Lloyd et al.

*Hewlett-Packard Journal,* vol. 36, No. 5 (May 1985), pp. 1-27.

*Primary Examiner*—Joseph W. Hartary

[57] ABSTRACT

Underpressure changes in an ink-jet pen (20, 120) reservoir (22, 122) are compensated for by volumetric changes in the reservoir (22, 122) effected by movement of a piston (56, 156) within a sleeve (50, 150) that is connected to the reservoir (22, 122). The piston (56, 156) and sleeve (50, 150) are sized to provide capillarity for holding ink (72, 172) therebetween. The ink (72, 172) between the piston (56, 156) and sleeve (50, 150) acts as a low-friction seal for preventing fluid communication between ambient air and the interior of the resevoir (22, 122). In one embodiment (120), the volumetric efficiency of the pen is enhanced with an auxiliary ink reservoir carried on the piston (156).

24 Claims, 3 Drawing Sheets

ACCUMULATOR AND PRESSURE CONTROL FOR INK-KET PENS

TECHNICAL FIELD

This invention pertains to mechanisms for regulating the pressure within the ink reservoir of an ink-jet pen.

BACKGROUND INFORMATION

Ink-jet printing has become an established printing technique and generally involves the controlled delivery of ink drops from an ink containment structure, or reservoir, to a printing surface.

One type of ink-jet printing, known as drop-on-demand printing, employs a pen that has a print head that is responsive to control signals for ejecting drops of ink from the ink reservoir. Drop-on-demand ink-jet pens typically use one of two mechanisms for ejecting drops: thermal bubble or piezoelectric pressure wave. The print head of a thermal bubble type pen includes a thin-film resistor that is heated to cause sudden vaporization of a small portion of the ink. The rapid expansion of the ink vapor forces a small amount of ink through a print head orifice.

Piezoelectric pressure wave pens use a piezoelectric element that is responsive to a control signal for abruptly compressing a volume of ink in the print head to thereby produce a pressure wave that forces the ink drops through the orifice.

Although conventional drop-on-demand print heads are effective for ejecting or "pumping" ink drops from a pen reservoir, they do not include any mechanism for preventing ink from permeating through the print head when the print head is inactive. Accordingly, drop-on-demand techniques require that the fluid in the ink reservoir must be stored in a manner that provides a slight underpressure within the reservoir to prevent ink leakage from the pen whenever the print head is inactive. As used herein, the term underpressure means that the fluid pressure within the reservoir is less than the pressure of the ambient air surrounding the reservoir. The units of underpressure measurement are given in positive values of water column height.

The underpressure in the reservoir must be strong enough for preventing ink leakage through the print head. The underpressure, however, must not be so strong that the print head is unable to overcome the underpressure to eject ink drops. Moreover, the ink-jet pen must be designed to operate despite environmental changes that cause fluctuations in the underpressure.

A severe environmental change affecting reservoir underpressure occurs during air transport of the pen. In this instance, the ambient air pressure drops as the aircraft gains altitude. This ambient air pressure drop reduces the underpressure level within the pen reservoir. If the underpressure reduction is not regulated, the underpressure will diminish to a level that is too low to keep ink from leaking through the print head.

The underpressure of an ink-jet pen reservoir is also subjected to what may be termed "operational effects." A significant operational effect on the reservoir underpressure occurs as the print head is activated to eject drops. The consequent depletion of ink from the reservoir increases the reservoir underpressure level. Without regulation of such underpressure increases, the ink-jet pen will eventually fail because the print head will be unable to overcome the increased underpressure to eject ink.

Past efforts to regulate ink-jet reservoir underpressure in response to environmental changes and operational effects have included various mechanisms that may be collectively referred to as accumulators. Examples of accumulators are described in U.S. patent application Ser. No. 07/289,876, entitled METHOD AND APPARATUS FOR EXTENDING THE ENVIRONMENTAL RANGE OF AN INK JET PEN CARTRIDGE.

Generally, prior accumulators comprise an elastomeric bladder or cup-like mechanism that defines a volume that is in fluid communication with the ink-jet pen reservoir volume. An accumulator is designed to move relative to the reservoir in response to changes in the level of the underpressure within the reservoir. Accumulator movement changes the overall volume of the reservoir to accommodate the underpressure level changes. As a result, the underpressure within the reservoir remains within an operating range that is suitable for preventing ink leakage but permits the print head to continue ejecting ink drops.

For example, as the underpressure within the pen decreases as a result of ambient air pressure drop, the accumulator moves to increase the reservoir volume to prevent the underpressure in the reservoir from diminishing to a level outside the operating range discussed above. Put another way, the increased volume attributable to accumulator movement prevents the underpressure drop that would otherwise occur if the reservoir were constrained to a fixed volume as ambient air pressure dropped.

Accumulators also move to decrease the reservoir volume whenever environmental changes or operational effects (for example, ink depletion during operation of the pen) cause an increase in the underpressure. The decreased volume attributable to accumulator movement keeps the underpressure from rising to a level outside of the operating range, thereby permitting the print head to continue ejecting ink.

Accumulators are usually equipped with resilient mechanisms that continuously urge the accumulators toward a position for increasing the air volume in the reservoir. The effect of the resilient mechanisms is to retain a sufficient minimum underpressure within the reservoir (to prevent ink leakage) even as the accumulator moves to increase or decrease the reservoir volume.

The effectiveness of an accumulator can be measured by the magnitude of the reservoir volumetric increase or decrease (that is, the magnitude of the pressure compensation range) that is provided for a given size of accumulator. Moreover, it is desirable that the accumulator consume as little space as possible so that the presence of the accumulator does not substantially reduce the ink capacity of the pen reservoir.

SUMMARY OF THE INVENTION

The present invention is directed to an accumulator for an ink-jet pen. The accumulator is constructed to maximize the underpressure compensation range of the accumulator while minimizing the space required to accommodate the accumulator within the ink-jet pen. Moreover, the accumulator of the present invention is economical to fabricate and to assemble.

One embodiment of the accumulator of the present invention particularly comprises a sleeve that is mounted to the ink-jet pen reservoir. A piston slides within the sleeve. The reservoir walls and the sleeve and piston define a reservoir volume, which volume is changeable as the piston moves within the sleeve.

As the underpressure within the reservoir changes, the piston moves to increase or decrease the volume of the reservoir to thereby maintain the reservoir underpressure within an operating range that ensures ink will not leak from the print head and that the print head will be able to continue ejecting ink from the reservoir.

A helical spring is positioned between the piston and the reservoir for maintaining a sufficient minimum underpressure as the piston moves to increase or decrease the reservoir volume. Use of a spring for this purpose is advantageous because the spring dimensions may be selected to establish any desired underpressure operating range within the reservoir. For example, print quality is generally highest when the reservoir underpressure is at the lowest operating level. Accordingly, the spring characteristics (diameter, number of turns, etc.) may be selected to provide a spring constant that affects piston movement in a manner that maintains the desired low-level underpressure within the reservoir.

Another advantage of using a spring as the resilient mechanism of the present accumulator arises from the predictability of the spring performance. In this regard, the force applied by the spring to the piston will vary in a predictable linear fashion with changes in the fluid pressure in the reservoir. Moreover, one spring will perform substantially the same as another similarly configured spring. Accordingly, unlike bladder-type accumulators (the performance characteristics of which are difficult to consistently duplicate), the present design ensures substantially uniform accumulator performance from one pen to another.

As another aspect of this invention, the piston and sleeve are constructed to define between them a capillary space. The capillary space is sized to support liquid between the piston and the sleeve. The liquid serves as a seal between the piston and sleeve so that the interior of the reservoir is sealed from ambient air.

The liquid seal provided by the capillary space eliminates the need for complex mechanisms for keeping ambient air from passing into the reservoir as a result of the normal underpressure maintained in the reservoir. Because no solid mechanisms (0-rings, membranes, etc.) are used to seal the space between the piston and sleeve, the piston can be constructed to have a working surface (i.e., the surface against which the underpressure within the reservoir acts to move the piston) that has an area that is very near the size of the cross-sectional area of the sleeve. Accordingly, the maximized working surface area of the piston maximizes the pressure compensation range of the accumulator.

More particularly, because the large working surface of the piston generates a correspondingly large force against the spring, the spring may be configured with a larger diameter wire, and/or a larger outside diameter. Since the buckling load of the spring increases with the square of the spring radius, a very small increase in diameter makes the spring much more resistant to buckling that would tend to bind movement of the piston.

The use of the liquid seal technique of the present invention avoids the loss of ink capacity in the reservoir that would occur if structural seal elements, the volumes of which are generally substantially greater than the volume of the liquid seal, were employed.

As ink is depleted during printing, the piston is moved by the resultant increased underpressure to a location where the piston can no longer move to decrease the volume of the reservoir. In the present invention, a mechanism is provided for directing fluid into the reservoir volume to relieve (that is, reduce) the underpressure within the reservoir so that the pen may continue to operate. In one embodiment of the present invention, the mechanism for providing relief fluid to the reservoir includes a number of slots formed in the sleeve. The slots are oriented and sized to permit fluid (for example, air) to pass into the reservoir volume to relieve the underpressure. The slots extend adjacent to the capillary space between the piston and the cylinder. As a result, the liquid held by the capillarity of that space normally seals the slots so that air will not move through the slots in the absence of a sufficient increase in the underpressure level within the reservoir. Accordingly, even if the pen is tipped or inverted the slots will remain sealed to prevent an undesirable loss of underpressure within the reservoir.

As another aspect if this invention, the space within the sleeve that is outside of the reservoir volume is enclosed to define an auxiliary reservoir. The auxiliary reservoir carries ink that may be drawn into the reservoir volume as the ink in the main reservoir is depleted. A vented cover is provided for prohibiting ink in the auxiliary reservoir from spilling out of the pen.

As another aspect of this invention, a sump is included for retaining an amount of liquid on the piston proximal to the capillary space. The liquid carried in the sump is available for replenishing ink that is forced out of the capillary space as air moves through the relief slots mentioned above.

DETAILED DESCRIPTION OF PREFERRED EMBODIMENTS

Figure 1:
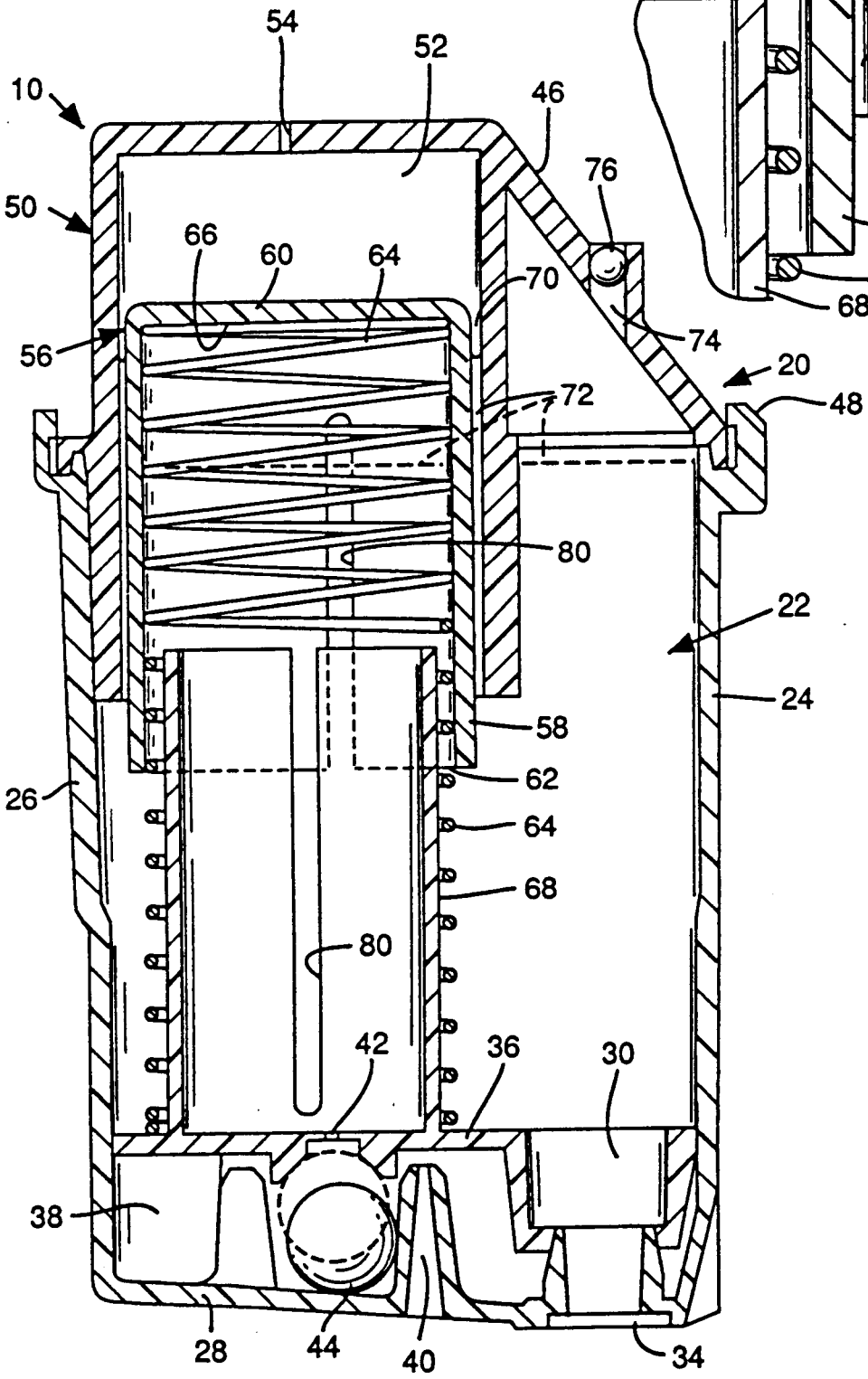
FIG. 1 is a cross-sectional view of an ink-jet pen employing an accumulator formed in accordance with this invention.

With reference to FIG. 1, one embodiment of an accumulator 10 of the present invention is adapted for use with a conventional ink-jet pen 20. The pen 20 is driven by known means back and forth adjacent to a printing medium and is precisely controlled for placing ink drops on the medium. The ink-jet pen 20 includes an ink reservoir 22 defined by rigid walls 24, 26, 28. A well 30 is formed in the base of the reservoir 22. A print head 34 is mounted in the base of the well 30 and includes a conventional thermal-bubble type drop generator for ejecting ink drops from the reservoir 22.

A support plate 36 surrounds the upper opening of the well 30 and extends across the reservoir 22 to define within the reservoir a catch basin 38 at the bottom of the pen 20. The catch basin 38 is vented to ambient air by a vent 40 formed in the bottom wall 28 of the reservoir 22.

A small orifice 42 is formed through the support plate 36 to provide fluid communication between the catch basin 38 and the interior of the pen reservoir 22 as described more fully below.

A rigid cap 46 is sealed to the top 48 of the side walls 24, 26 of the reservoir 22. The cap 46 is configured to define a cylindrical sleeve 50 that extends partly into the interior of the reservoir 22. The sleeve 50 has an internal chamber 52 that is vented to ambient air through an aperture 54 formed in the reservoir cap 46.

A piston 56 is disposed for sliding movement within the sleeve 50. The piston 56 comprises a rigid cylinder 58 that is closed at the top 60 and open at the bottom 62. The interior reservoir volume is generally defined by the walls 24, 26, 28, cap 46, and piston top 60. Consequently, changes in the piston position change the size of that volume.

A stainless steel spring 64 is confined at one end to the undersurface or working surface 66 of the piston top 60. The spring 64 extends downwardly from the piston and rests on the support plate 36.

A tubular spring guide 68 is mounted to the support plate 36 and extends upwardly inside of the spring 64. The guide 68 prevents the spring 64 from buckling out of its concentric alignment with the piston 56 and sleeve 50.

The piston 56 and sleeve 50 are sized to define a space 70 (FIG. 2) therebetween that will support a capillary rise of liquid, such as the ink 72 with which the reservoir is filled. The ink 72 within the space 70 provides a seal between the sleeve 50 and piston 56 for preventing ambient air from moving through the space 70 into the reservoir 22. It can be appreciated that unrestricted ambient air movement into the reservoir 22 would eliminate any underpressure within the reservoir, and the ink 72 would leak from the print head 34.

The ink 72 held by the capillarity within space 70 acts as a liquid bearing that facilitates low-friction movement of the piston within the sleeve. Consequently, the piston 56 is easily movable to compensate for underpressure changes in the reservoir 22.

In the preferred embodiment, the sleeve 50 may be formed of a rigid wettable material, such as polyphenylene oxide or polysulfone. The piston 56 is also a very rigid wettable element formed, for example, from polyphenylene oxide. The piston 56 and sleeve 50 should be sized so that the thickness T (FIG. 2) of the space 70 between the piston 56 and sleeve 50 is between 0.025 mm and 0.050 mm. This spacing results in capillarity that is high enough to keep the liquid seal in place, despite a normal pressure head difference of up to 13 cm (water column) between the reservoir interior and ambient air. For conventional printing inks, the size of the capillary space is such that it will support a maximum capillary rise of between 60 cm (water column) and 100 cm (water column).

Prior to operation of the pen, the reservoir 22 is filled with ink 72 through an opening 74 in the cap 46, which opening is thereafter sealed with a plug 76. As the reservoir 22 is filled, the spring 64 is relaxed and the piston 56 is held within the sleeve 50 as shown in FIG. 1.

As noted earlier, it is important that an underpressure be established and maintained in the ink reservoir 22 in order to keep ink from leaking through the print head 34. Accordingly, after the reservoir 22 is filled, a slight underpressure of about 1.3 cm (water column) is established within the reservoir 22 by, for example, ejecting a small amount of ink from the print head 34.

In the first embodiment, shown in FIG. 1, a conventional drop-on-demand type print head will function properly (that is, ink will not leak through it when the print head is inactive, and the print head will be able to eject ink until the reservoir is empty) as long as the underpressure in the reservoir 22 is within an operating range of between about 1.3 cm (water column) and about 12.7 cm (water column).

As the print head 34 is operated to eject ink during printing, the consequent depletion of the ink 72 increases (makes more negative) the underpressure within the reservoir 22. The underpressure acts on the working surface 66 of the piston 56 to draw the piston 56 downwardly toward the support surface 36, thereby decreasing the interior volume of the reservoir 22 to keep the underpressure from increasing to a level so high that the print head 34 would be unable to eject ink from the reservoir 22.

In the event that the piston 56 is moved by the increased underpressure to a location (for example, against the top of the spring guide 68) where the piston can no longer decrease the volume of the reservoir 22, any additional increase in the underpressure will draw air bubbles through the orifice 42 to relieve the underpressure to an extent necessary to keep the underpressure within the appropriate operating range. It is noteworthy that the orifice 42 is small enough (for example, 200 microns) so that ambient air will not move through it into the ink-covered bottom of the reservoir 22 until the underpressure reaches the level that pulls the piston 56 to its lowest point. Moreover, in the event that the pen is tipped so that ink in the bottom of the reservoir 22 moves away from the orifice 42, a ball-type check valve 44 housed within the catch basin 38 will close against the orifice 42 to prevent ambient air in the catch basin 38 from passing through the orifice 42 and eliminating the underpressure in the reservoir 22.

The piston 56 and spring guide 68 include longitudinal slots 80. The slots 80 ensure that any air entering the reservoir 22 through the orifice 42 will be able to pass throughout the reservoir 22 and not become trapped within the piston 56 to resist downward movement of the piston. The slots 80 also ensure that ink will flow from under the piston top 60 to the print head 34.

In the event that the ink-jet pen 20 is subjected to environmental effects (for example, an ambient pressure drop) that decrease the reservoir underpressure level, the lowered underpressure acting on the working surface 66 of the piston 56 will permit the spring 64 to move the piston upwardly, thereby increasing the overall volume of the reservoir 22 to keep the underpressure from decreasing to a level so low that the ink would leak through the print head 34.

In view of the above, it can be appreciated that the accumulator of the present invention provides a piston 56 having a working surface 66 that is large relative to the cross-sectional area of the sleeve 50. This large working surface is generally attributable to the liquid seal mechanism employed, which permits the piston to extend very close to the sleeve of the accumulator. Moreover, the accumulator of the present invention is constructed to consume a minimal amount of reservoir space so that the ink capacity of the pen may be maximized.

Figure 3:
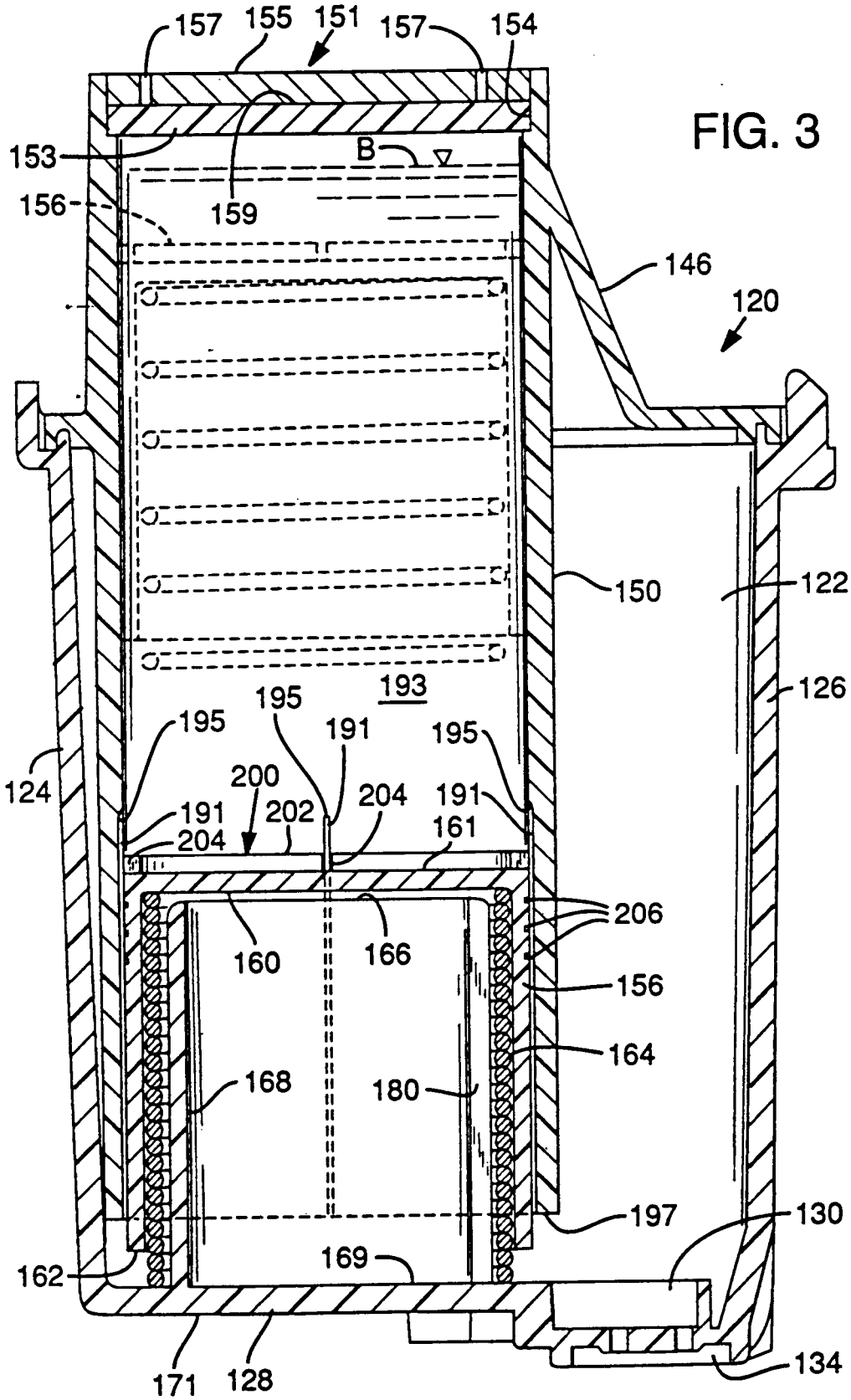
FIG. 3 is a cross-sectional view of an ink-jet pen employing an alternative embodiment of an accumulator in accordance with this invention.
Figure 4:
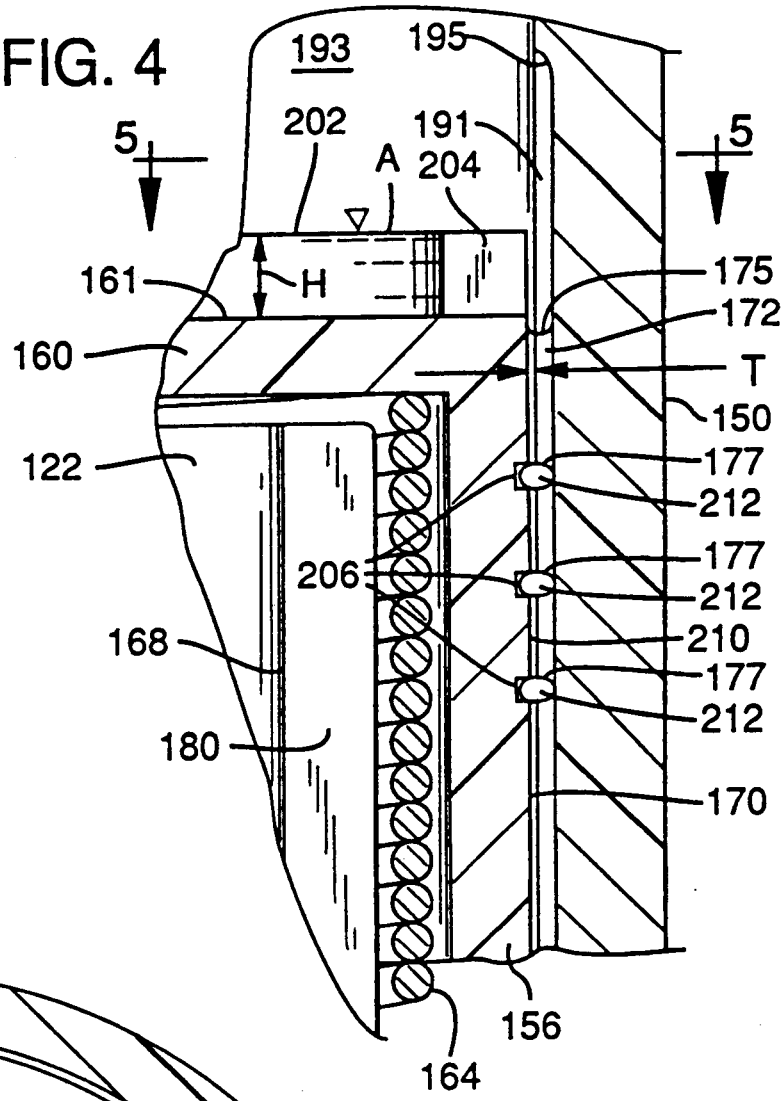
FIG. 4 is an enlarged portion of the cross-sectional view of FIG. 3.
Figure 5:
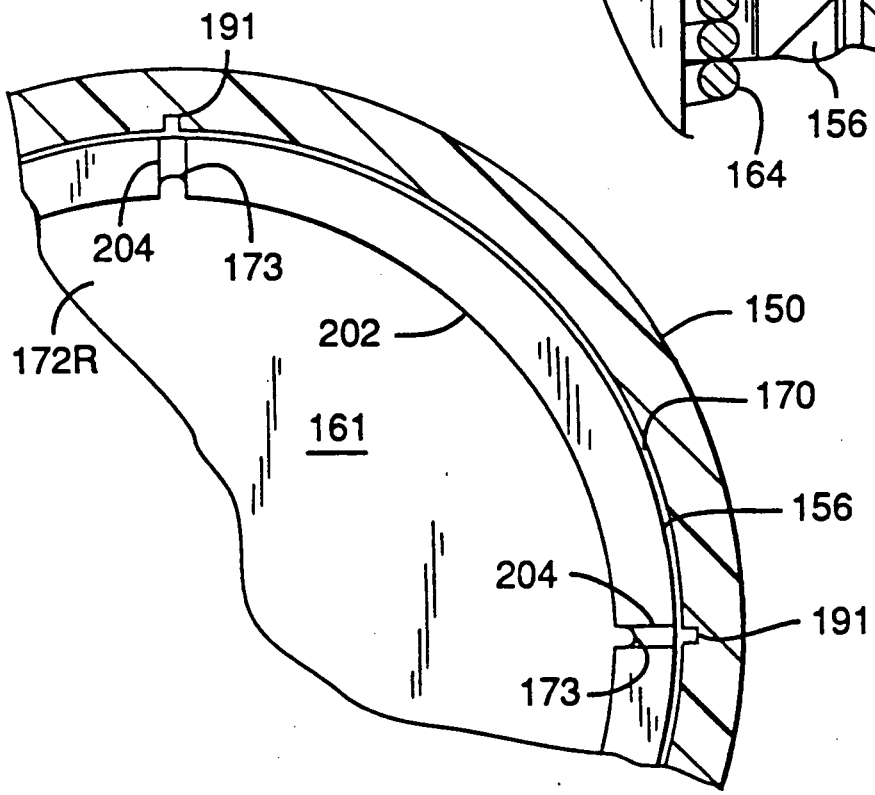
FIG. 5 is a partial top view taken along line 5—5 in FIG. 4.

A second preferred embodiment of the accumulator apparatus of the present invention is illustrated in FIGS. 3, 4 and 5. In this embodiment, the pen 120 includes a reservoir 122 that has rigid walls 124, 126, 128 that are configured to hold a quantity of ink. A well 130 is formed in the base of the reservoir 122. A conventional print head 134 is mounted to the well for ejecting ink drops from the reservoir 122.

A rigid cap 146 is sealed to the top of the sidewalls 124, 126 of the reservoir 122. The cap 146 is configured to define a cylindrical sleeve 150 that extends into the interior of the reservoir 122. The bottom 197 of the sleeve 150 is near the bottom wall 128 of the reservoir.

A piston 156 is disposed for sliding movement within the sleeve 150. The piston 156 comprises a rigid cylinder 158 that is closed at the top 160 and open at the bottom 162. A stainless steel spring 164 is confined at one end to the working surface 166 of the piston top 160. The spring 164 extends downwardly from the piston and rests upon the bottom wall 128 of the pen 120.

A tubular spring guide 168 is mounted to the bottom wall 128 of the reservoir and extends upwardly inside of the spring 164. The spring guide 168 has a lengthwise gap 180 formed through it so that ink does not become trapped beneath the piston 156 whenever the piston is lowered over the spring guide, as described more fully below.

The piston 156 and sleeve 150 are sized to define a capillary space 170 (FIGS. 4 and 5) therebetween that will support a capillary rise of liquid, such as the ink 172 (FIG. 4), with which the reservoir is filled. The ink 172 provides a seal between the sleeve 150 and piston 156 for preventing ambient air from being drawn through the space 170 and into the reservoir 122 by the reservoir operating underpressure. As in the first-described embodiment, the thickness of the space 170 between the piston 156 and sleeve 150 is between about 0.025 mm and 0.050 mm.

The top of the sleeve 150 is closed with a cover 151 (FIG. 3) that permits air to pass into the interior of the sleeve 150 above the piston 156. The cover 151 includes a rigid vent member 153, the edge of which fits into a recess 154 formed in the top of the sleeve. The vent member 153 comprises material that is substantially pervious to air but impervious to water. Preferably, the vent member is a 2 mm thick piece of porous polytetraflourethylene, such as manufactured by E. I. DuPont de Nemours and Co., under the trademark Teflon. Consequently, any liquid that resides in the sleeve 150 above the upper surface 161 of the piston top 160 (as described more fully below) will not spill out of the pen through the cover 151 should the pen be tipped or inverted. The space above the piston 156 will remain at ambient pressure, however, because air is free to pass through the vent member 153.

A rigid cover plate 155 is fastened to the top of the sleeve 150 just above the vent member 153. The cover plate 155 includes eight apertures 157 formed therethrough at equally spaced locations about the periphery of the cover plate 155 (only two apertures 157 appear in FIG. 3). The apertures are preferably 0.5 mm in diameter and 1.5 mm in length. The provision of the cover plate 155 serves to limit the evaporation loss from the reservoir 122 that might otherwise occur if the entire upper surface 159 of the vent member 153 were exposed to ambient air.

FIG. 3 depicts in solid lines the position of the piston 156 after enough ink has been ejected by the print head 134 to increase the underpressure to such an extent that the piston can move no lower to reduce the volume of the reservoir 122. In this regard, coil-to-coil contact of the spring acts as a stop for limiting the downward motion of the piston.

Continued ejection of ink by the print head 134 will continue to increase the underpressure within the reservoir 122. This embodiment of the invention includes a relief mechanism for directing fluid into the reservoir volume to relieve the underpressure by an amount sufficient to permit the print head to continue operating to eject substantially all of the ink within the reservoir.

The relief mechanism particularly comprises elongated slots 191 formed in the inner surface 193 of the sleeve 150 at uniformly spaced-apart locations. The slots 191 extend upwardly parallel to the longitudinal axis of the sleeve 150 from a location adjacent to the bottom 197 of the sleeve 150. The upper end 195 of each slot 191 is located above the piston top 160 when the piston 156 is in its lowest position (FIG. 3). Preferably, the slots 191 are approximately 0.30 mm by 0.30 mm in cross section.

When the pen 120 is filled with ink (for example, by supplying ink through the sleeve top before the cover 151 is fastened thereto) and the initial underpressure is generated within the reservoir 122, the piston 156 will be at a location above the slots 191, such as shown in dashed lines in FIG. 3.

Whenever, the piston 156 is drawn by increased underpressure to its lowest position, however, the upper end 195 of the slots are exposed to the ambient air that resides above the piston top 160. Moreover, the slots 191 are sized so that once the underpressure exceeds the level that forces the piston 156 to its lowest point (for example, 7.5 cm water column), the underpressure will draw bubbles of ambient air downwardly through the slots 191 and into the reservoir volume. The air drawn into the reservoir 122 will keep the underpressure from exceeding the operating range as described above.

Figure 2:
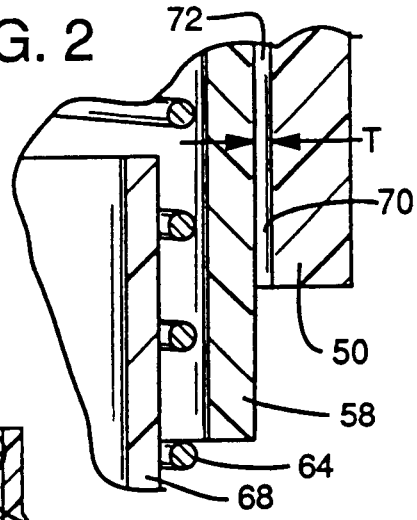
FIG. 2 is an enlarged portion of the cross-sectional view of FIG. 1 showing the liquid seal provided between the piston and sleeve of the present accumulator.

As a bubble of air is drawn through a slot 191 into the reservoir 122, the bubble remains substantially surrounded by the ink 172 that is retained in the vicinity of the slot 191 by the capillarity of the space 170. Accordingly, the fluid path defined by each slot 191 is never completely open between the interior of the reservoir and the space above the piston (that is, the path is never completely empty of ink). As a result, the underpressure within the reservoir 122 is maintained even though the pen may be tipped or inverted. Put another way, no separate mechanism, as shown in the first embodiment, FIGS. 1 and 2, is necessary for closing the fluid path defined by the slots 191 in the event the pen is tipped or inverted.

In the event of an environmental change that causes the underpressure within the reservoir to rise (for example, as a result of an ambient pressure drop) the piston 156 will rise above the upper ends of the slots 195, hence eliminating the fluid path defined by the slots 191 between ambient air and the interior of the reservoir. In the present embodiment, therefore, there is no catch basin employed for receiving fluid driven from the reservoir as the underpressure continues to increase after the piston 156 reaches its maximum travel distance for increasing reservoir volume.

As air bubbles are drawn through the slots 191, as described above, a small amount of ink 172 is pushed by the bubbles out of the slots 191 as the bubbles exit the bottom 197 of the sleeve 150. The ink forced out of the slots 191 is immediately replenished from the ink remaining in the reservoir because the capillarity of the space 170 draws the reservoir ink upwardly into the slots 191.

As the quantity of this reservoir ink (that is, the ink outside of the capillary space 170) is reduced during printing to a level beneath the bottom 197 of the sleeve 150, ink forced out of the slots 191 by the air bubble movement therethrough will no longer be replenished from the reservoir ink because the capillary space 170 no longer contacts the reservoir ink. Consequently, the slots 191 begin to empty, which may lead to a continuous air path along the slots 191 between ambient air and the reservoir interior, which, in turn, could cause loss of underpressure within the reservoir before all of the reservoir ink is expelled from the pen. The embodiment of FIG. 3, however, carries a reserve supply of ink for replenishing ink within the slots 191 after the reservoir ink level moves too low (that is, beneath the sleeve bottom 197) to replenish the ink lost from the slots. The reserve ink, therefore, functions to maintain the liquid seal within the slots 191, until substantially all of the reservoir ink is completely ejected.

The reserve ink supply is carried in a sump 200 that comprises an annulus 202 formed to extend around the perimeter of the upper surface 161 of the piston top 160. The annulus 202 includes four uniformly spaced-apart slits 204. Each slit 204 extends radially through the annulus 202 and is approximately 0.35 mm wide (FIG. 5).

The height H (FIG. 4) of the annulus 202 and width of the slits 204 are selected so that when the sump 200 is filled (that is, filled to the level shown as A in FIG. 4) with reserve ink 172R, there will be insufficient static head in the reserve ink 172R to overcome the capillary attraction between the reserve ink and the walls of the narrow slits 204 in the annulus 202. Accordingly, the reserve ink 172R forms a meniscus 173 inside each slit 204.

Reserve ink 172R is delivered to the capillary space 170 (hence, to the ink-depleted slots 191) as the pen 120 reciprocates during printing. More particularly, the pen is driven back and forth (for example, into and out of the plane of FIG. 3) during a conventional printing operation. As the pen reverses direction at the edge of the paper that is being printed, the inertia in the body of the reserve ink 172R propels a small amount of ink through the slit 204 that is nearest the paper edge.

The function of the reserve ink 172R may also be accomplished with other fluids. For example, the sump 200 may be filled with an immiscible, low-density, high vapor-pressure fluid, such as that produced by Shell Oil Company under the trademark "Rotella T", or common mineral oil.

Such a fluid, unlike ink, would also be less likely to evaporate. Evaporation of the water component of ink is undesirable because the viscosity of the ink remaining in the sump increases to a level such that the ink no longer readily flows from the sump into the slots 191 to maintain the liquid seal, as described above.

A sludge of viscous ink may form in the capillary space 170 in low humidity environments, thereby impeding piston movement. A second function of the reserve fluid is to act as a vapor barrier to the loss of the water component of the ink that is beneath it.

The space within the sleeve 150 above the piston 156 may also be advantageously employed as an auxiliary reservoir of ink that is available for printing, thereby increasing the overall capacity and volumetric efficiency of the pen. To this end, ink may be added to the sleeve 150, above the piston top 160 (for example, to liquid level B shown in FIG. 3) after the main reservoir 122 is filled with ink. The maximum amount of ink that may be added above the piston 156 is limited by the amount of reduction in the reservoir underpressure that occurs as the spring 164 is deflected downwardly (hence, reducing the reservoir volume) by the weight of the ink that is added above the piston. In short, the quantity of ink added above piston 160 should not be great enough to move the piston to a position so low that the underpressure is correspondingly reduced to a level outside of the underpressure operating range. The underpressure is preferably established at 7.5 cm water column.

When the auxiliary ink supply is available, the column of ink that is above the piston 156 will be displaced into the main reservoir 122 because a fluid flow potential is created between the auxiliary and main reservoirs, and because the capillarity in capillary space 170 has been removed due to the elimination of the air/fluid interface shown at 175 in FIG. 4. Specifically, flow will occur because the 7.5 cm (water column) underpressure acts on the ink stored in the area above the capillary space 170. Since the underpressure is very slight and the area is very small, the consequent hydraulic flow is very gradual. Over an extended period of time, however, the gradual flow of auxiliary ink into the main reservoir will reduce the underpressure within the reservoir. The underpressure reduction causes the piston 156 to move upwardly relative to the sleeve 150, thereby increasing the volume of the reservoir to counter the underpressure reduction. When the piston 156 has risen to level B (FIG. 3), all of the available auxiliary ink will have been drawn into the reservoir 122, and the air/fluid interface 175 will be reestablished. It is noteworthy that this aspect of the invention provides a convenient means to refill the pen during use, since additional ink may be added at atmospheric pressure to the auxiliary reservoir.

In the event printing occurs while ink is stored in the auxiliary reservoir, the increase in underpressure will cause the piston to move downwardly, thereby exposing the slots 191. Ink flow between the two reservoirs will increase in proportion to the increase flow area provided by the slots 191. When the printing is stopped, the exchange of fluid from the auxiliary to the primary reservoir 122 will continue until the air/fluid interface 175 is reestablished as described above.

It may be desirable in certain applications to further reduce the very slight flow of auxiliary ink into the reservoir 122 as described above. To prevent this ink flow, the pen 120 of the present embodiment includes an air lock mechanism for restricting the flow through the capillary space 170, at the design underpressure (7.5 cm water column). This reduction of ink flow is accomplished by reducing the annular flow area between the piston and sleeve by introducing a toroidal bubble of air in each of three air locks. Specifically, the air lock mechanism comprises a series of three spaced-apart circumferential grooves 206 formed in the outer surface 210 of the piston 150 (FIG. 4) near the piston top 160. Air precipitating out of the ink, or introduced during the initial fill process is trapped within the grooves 206 to thereby define along each groove an air/fluid interface or meniscus 179 that impedes downward liquid flow.

Since the cross-sectional area of the circumferential groove 206 is greater than that of the capillary space 170, air that passes through the capillary ink expands into the grooves to form the meniscus 179 (FIG. 4) that defines trapped air bubbles 212. The meniscus 179, the air sides of which are at a lower pressure than any air bubble in the capillary space 170, attract any free air in the ink. Moreover, because the pressure within the trapped bubbles 212 would have to be increased for the bubble to enter the capillary space 170, the meniscus 179 will remain in place. Ink traveling downwardly through the capillary space is restricted to flow along the thin fluid web between the bubble 212 and the sleeve inner surface 193. The existence of the meniscus 179 restricts the flow area in the capillary space 170 to such an extent that the above-discussed gradual ink flow from the auxiliary to the main reservoir 122 is effectively eliminated. Preferably, three grooves 206 are provided.

The grooves 206 are preferably 0.30 mm×0.30 mm in cross section. Air is collected in the grooves 206 initially as a by-product of the manufacturing process. In this regard, the pen reservoir 122 is initially evacuated to approximately 500 to 600 mm Hg, and ink is injected under pressure (approximately 15 psi) into the reservoir. Some of the pressurized air is dissolved into the ink, and after the pressure is withdrawn, air comes out of solution, and some air is trapped within the grooves 206 as the low pressure (that is, relative to ambient) bubbles 212 mentioned above. The air bubbles 212 restrict fluid flow, but do not otherwise impede motion of piston 156 relative to the sleeve 150.

Although the principles of the invention have been described and illustrated with reference to a preferred embodiment, it should be apparent to one of ordinary skill in the art that the invention can be further modified in arrangement and detail without departing from such principles.

We claim:

1. An accumulator apparatus for an ink-jet pen or the like, comprising:

a reservoir;

a sleeve connected to the reservoir; and a piston member mounted within the sleeve, the reservoir, sleeve and piston member defining a reservoir volume, the piston member being movable within the sleeve for changing the size of the reservoir volume, the piston member and sleeve being configured to define a capillary space for supporting liquid between the piston member and sleeve.

2. The apparatus of claim 1 wherein the piston member and sleeve are configured so that the space therebetween provides capillarity that is sufficient to retain liquid within the space despite movement of the piston member within the sleeve.

3. The apparatus of claim 2 wherein the thickness of the space between the sleeve and the piston member is between about 0.025 mm and 0.050 mm.

4. The apparatus of claim 1 further including a spring connected to the piston member for urging the piston member toward a position for increasing the reservoir volume.

5. The apparatus of claim 4 wherein the spring is a helical type.

6. The apparatus of claim 4 further including a rigid guide for supporting the spring against buckling.

7. An accumulator apparatus for an ink-jet pen or the like, comprising:

a reservoir;

a sleeve connected to the reservoir;

a piston member mounted within the sleeve, the reservoir, sleeve and piston member defining a reservoir volume, the piston member being movable within the sleeve for changing the size of the reservoir volume; and a liquid seal disposed between the piston member and sleeve.

8. The apparatus of claim 7 wherein the liquid seal comprises liquid held by capillary force between the sleeve and the piston member.

9. The apparatus of claim 8 wherein the piston member and sleeve are configured so that the space therebetween provides capillarity that is sufficient to retain liquid within the space despite movement of the piston member within the sleeve.

10. The apparatus of claim 9 wherein the thickness of the space between the sleeve and the piston member is between about 0.025 mm and 0.050 mm.

11. An accumulator apparatus for an ink-jet pen or the like, comprising:

a reservoir;

a sleeve connected to the reservoir;

a piston member mounted within the sleeve, the reservoir, sleeve and piston member defining a reservoir volume, the piston member being movable within the sleeve for changing the size of the reservoir volume, the piston member and sleeve being configured to define a capillary space for supporting liquid between the piston member and sleeve, the piston member being movable into a first position whenever the pressure within the reservoir volume reaches a first level; and relief means operable while the piston member is in the first position for delivering fluid to the reservoir volume.

12. The accumulator of claim 11 wherein the relief means includes a slot formed in the sleeve and arranged so that one end of the slot is exposed outside of the reservoir volume whenever the piston member is in the first position, the slot being arranged to define a fluid path into and out of the reservoir volume.

13. The accumulator of claim 12 wherein the piston member is movable into a second position whenever the pressure within the reservoir volume reaches a second level, the piston member substantially eliminating the fluid path into and out of the reservoir volume whenever the piston member is in the second position.

14. The accumulator of claim 11 further comprising a refillable auxiliary reservoir defined by the sleeve and the piston member for storing fluid near the reservoir volume.

15. The accumulator of claim 14 wherein the sleeve includes vent means for permitting ambient air to pass between the auxiliary reservoir and ambient.

16. The accumulator of claim 15 wherein the vent means includes a piece of vent material that is substantially impervious to liquid.

17. The accumulator of claim 16 wherein the vent means also includes a cover plate positioned adjacent to the vent material for restricting evaporation of fluid within the auxiliary reservoir, the cover plate having at least one aperture formed therethrough.

18. The accumulator of claim 14 further including air lock means for restricting fluid flow from the auxiliary reservoir to the reservoir volume through the capillary space.

19. The accumulator of claim 18 wherein the air lock means comprises a groove formed in the piston member for trapping air within the capillary space while liquid is supported within the space.

20. The accumulator of claim 11 further including sump means carried on the piston member for replenishing liquid that is depleted from the capillary space.

21. The accumulator of claim 20 wherein the sump means includes vapor barrier means for inhibiting evaporation of fluid within the reservoir.

22. An accumulator apparatus for an ink-jet pen, comprising:

a reservoir;

a sleeve connected to the reservoir;

a piston member movable within the sleeve, the reservoir, sleeve and piston member defining a reservoir volume, the piston member being movable within the sleeve in response to changes in the pressure within the reservoir volume, the piston member moving to a first position whenever the pressure in the reservoir volume reaches a first pressure, the sleeve having a slot formed therein to define a fluid path into the reservoir volume, a portion of the slot being exposed outside of the reservoir volume whenever the piston member is in the first position; and seal means for sealing the piston member and sleeve to restrict air movement between the piston member and sleeve.

23. The accumulator of claim 22 wherein the seal means includes liquid held in a capillary space between the piston member and sleeve.

24. The accumulator of claim 23 wherein the sleeve, piston member and slot are sized to permit air bubbles to flow through the slot into the reservoir volume whenever the piston member is in the first position.

* * * * *